US006253953B1

(12) United States Patent
Ishizuka

(10) Patent No.: US 6,253,953 B1
(45) Date of Patent: Jul. 3, 2001

(54) AUTOMATIC HIGH-SPEED PILL COUNTING APPARATUS

(75) Inventor: Akira Ishizuka, Ageo (JP)

(73) Assignee: Yunitec Co., Ltd., Saitama-Ken (JP)

( * ) Notice: Subject to any disclaimer, the term of this patent is extended or adjusted under 35 U.S.C. 154(b) by 0 days.

(21) Appl. No.: 09/003,501

(22) Filed: Jan. 6, 1998

(30) Foreign Application Priority Data

Jun. 26, 1997 (JP) ..... 9-170438

(51) Int. Cl.[7] ..... G07F 11/00
(52) U.S. Cl. ..... 221/13; 221/277
(58) Field of Search ..... 221/2, 7, 9, 13, 221/17, 258, 277, 266, 265, 92

(56) References Cited

U.S. PATENT DOCUMENTS 3,368,713 2/1968 Hurst et al. .
6,161,721 * 12/2000 Kudera et al. ..... 221/277

FOREIGN PATENT DOCUMENTS 2189914 11/1987 (GB) .
58-66186 4/1983 (JP) .
60-34620 10/1985 (JP) .

* cited by examiner

*Primary Examiner*—Kenneth W. Noland
(74) *Attorney, Agent, or Firm*—Pillsbury Winthrop LLP

(57) ABSTRACT

An automatic high-speed pill counting apparatus comprising: a cylindrical pill hopper 3 having a pill exit 10 and a center hole in a base plate 2; a rotational separative feeder 5 mounted in the cylindrical pill hopper and removably fitted on a shaft 6 borne in the center hole of the base plate, the feeder including an upper diametrically smaller portion 5*b* and a lower diametrically larger portion 5*c* having an external diameter approximate to the internal diameter of the lower portion of the pill hopper, a multiplicity of vertically through holes 5*c* being formed in the outer circumference of the lower diametrically larger portion and allowed to come into alignment with the pill exit for accommodating a plurality of pills vertically, the multiple vertically through holes 5*d* being enlarged at their lower portions, a ring-shaped slit 8 being formed in such a position in the outer circumference of the lower diametrically larger portion as to accommodate substantially one pill from the bottom; and a pill separating plate 11 mounted on the cylindrical pill hopper 3 above the pill exit and having an inwardly projected tip fitted loosely in the slit 8. The apparatus can count the pills quickly and accurately while preventing the inner wall of the cylindrical portion of the hopper from becoming dirty and the pills from being soiled or broken.

5 Claims, 5 Drawing Sheets

AUTOMATIC HIGH-SPEED PILL COUNTING APPARATUS

DETAILED DESCRIPTION OF THE INVENTION

1. Field of the Invention

The present invention relates to an automatic high-speed pill counting apparatus for general purposes to prevent the pills from being soiled or broken and to count the pills quickly and accurately.

2. Prior Art

In the case of counting the number of pills in the prior art, there is a system in which the pills are conveyed in a row, while being oscillated, by a part feeder or in which the pills are conveyed in multiple rows, while being oscillated, by a linear feeder, so that their number is counted at the conveyor end. In this series feeder system, the conveyance path is elongated to make the pills liable to become dirty. If the oscillations are intensified, an error is caused in the counted number by an overlap of pills. At a transfer from high- to low-speed conveyances, the oscillations have to be delicately adjusted for preventing the over-count. This frequently raises problems in the speed-up.

In order to enhance the reliability in the discharge of pills thereby to ensure an accurate counting, for example, there is a separate feeder system, as disclosed in Examined Japanese Utility Model Publication No. 60-34620. In this separate feeder system, as shown in FIG. 7, the pills, as poured into a hopper 32, sequentially fall into a cylinder 33 and further sequentially into an intermediate portion between a rotary alignment bed 35 and the cylindrical portion 33 so that they are conveyed into a notch 37 which is held at a predetermined spacing from a flange 36, until they are discharged out of a pill exit 39.

Since a tongue 41 protruded from a partition member 40 is arranged above the pill exit 39, only the pill, as admitted by one hole having the pill width of the tongue 41, arrives over the pill exit 39 so that it is discharged. Here in FIG. 7, reference numeral 31 designates a casing having a rectangular section, and numeral 42 designates corners having a round shape.

In the aforementioned separate feeder system, however, the pills are rubbed by the inner wall of the cylindrical portion so that the inner wall becomes dirty. If the numerous pills are agitated in the cylindrical portion, powder is produced to soil the pills themselves. Moreover, the powder agglomerates, when it is discharged, to raise a problem in the safety of medicine.

Moreover, the pill exit has such a restricted opening as to catch the pills thereby to damage or break them. Thus, this system is not suitable for the high speed so that it can be employed exclusively at a low speed.

SUMMARY OF THE INVENTION

It is, therefore, an object of the invention to provide an automatic high-speed pill counting apparatus which is constructed to prevent the inner wall of the cylindrical portion of a hopper from becoming dirty thereby to prevent the pills from being soiled or broken and to count the pills quickly and accurately thereby to solve the above-specified problems.

In view of the background thus described, according to the invention, there is provided an automatic high-speed pill counting apparatus comprising: a cylindrical pill hopper having a pill exit and a center hole in a base plate; a rotational separative feeder rotatably mounted in the lower portion in the cylindrical pill hopper and removably fitted on a shaft borne in the center hole of the base plate, the feeder including an upper diametrically smaller portion and a lower diametrically larger portion having an external diameter approximate to the internal diameter of the lower portion of the pill hopper, a multiplicity of vertically through holes being formed in the outer circumference of the lower diametrically larger portion and allowed to come into alignment with the pill exit for accommodating a plurality of pills vertically, the lower portions of the multiple vertically through holes being diverged downward, a ring-shaped slit being formed in such a position in the outer circumference of the lower diametrically larger portion as to accommodate substantially one pill from the bottom; a pill separating plate mounted on the cylindrical pill hopper above the pill exit and having an inwardly projected tip fitted loosely in the slit; a drive motor for driving the shaft; and a pill passage counting sensor arranged below the pill exit.

In the automatic high-speed pill counting apparatus, moreover, the multiple through holes of the lower diametrically larger portion of the rotational separative feeder include a multiplicity of notches formed in the outer circumference of the lower diametrically larger portion, and a thin sheet fixed on the notches in the outer circumference of the lower diametrically larger portion.

In the automatic high-speed pill counting apparatus, moreover, a diametrically larger groove is formed in the lower portion of the inner wall of the cylindrical pill hopper and has a diameter approximate to the external diameter of the lower diametrically larger portion of the rotational separative feeder.

The automatic high-speed pill counting apparatus further comprises: first control means for controlling in such a manner that the drive motor is driven at a high speed to rotate the rotational separative feeder at a high speed thereby to discharge the pills from the pill exit and count them by the pill passage counting sensor, that when the number of pills is approximate to a set number the drive motor is driven at a low speed to rotate the rotational separative feeder at a low speed and count the pills by the pill passage counting sensor, and that when the number of pills reaches a set number the drive of the drive motor is interrupted.

Moreover, multiple rows of the cylindrical pill hoppers are connected to the lower end of one mass hopper, and the automatic high-speed pill counting apparatus further comprises: second control means for controlling in such a manner that the individual drive motors is driven at a high speed to rotate the indivisual rotational separative feeders at a high speed thereby to discharge the pills from the individual pill exits and add the number counted by the indivisual pill passage counting sensor, that when the number of pills is approximate to a set number only one drive motor is driven at a low speed to rotate one rotational separative feeder at a low speed and count the pills by one pill passage counting sensor thereby to interrupt the drives of the remaining drive motors, and that when the number of pills reaches a set number the drives of all the drive motors are interrupted.

EMBODIMENTS OF THE INVENTION

The automatic high-speed pill counting apparatus according to the invention will be described in connection with its embodiments with reference to the accompanying drawings.

Figure 1:
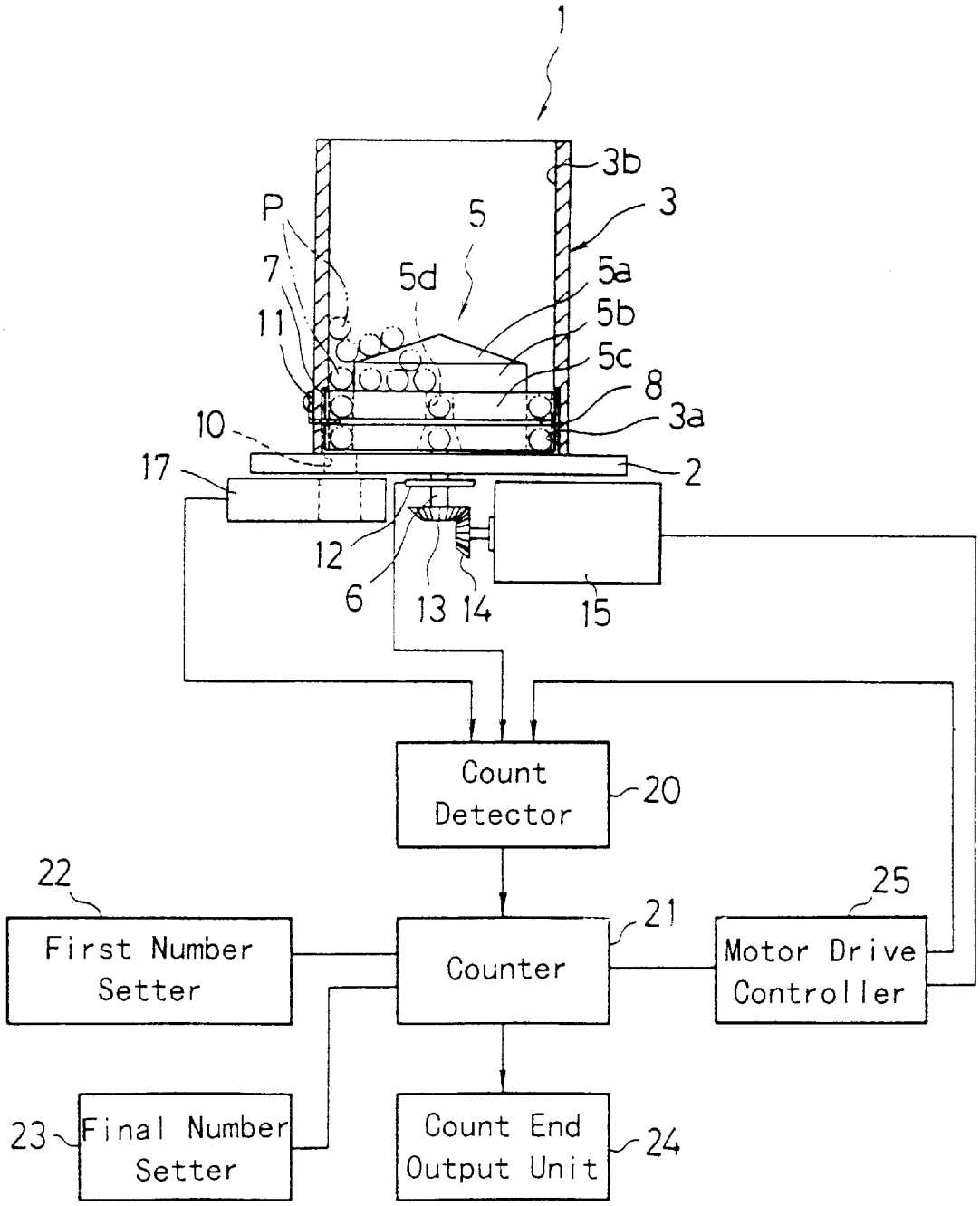
FIG. 1 is a block diagram of a mechanism and a system of an automatic high-seed pill counting apparatus according to the invention.

FIG. 1 is a block diagram of a mechanism and a system of the automatic high-seed pill counting apparatus according to the invention. As shown in FIG. 1, the automatic high-speed pill counting apparatus 1 has a base plate 2, on which is erected a cylindrical pill hopper 3.

In the lower portion of the cylindrical pill hopper 3, there is formed a diametrically enlarged groove 3*a*. On the upper face of the base plate 2 in the cylindrical pill hopper 3, there is rotatably supported a multistage rotational separative feeder 5 having a circular top plan shape through a shaft 6 extending through the base plate 2. This multistage rotational separative feeder 5 is removably fitted on the shaft 6.

The multistage rotational separative feeder 5 is composed, sequentially downward in the following recited order, of: an upper agitating portion 5*a* having a plurality of steps for agitating pills P; a diametrically smaller portion 5*b* having such a predetermined gap between itself and the inner circumference 3*b* of the pill hopper 3 as to allow substantially one pill to pass therethrough; and a diametrically larger portion 5*c* fitted loosely in the diametrically larger groove 3*a* of the pill hopper 3.

Figure 2:
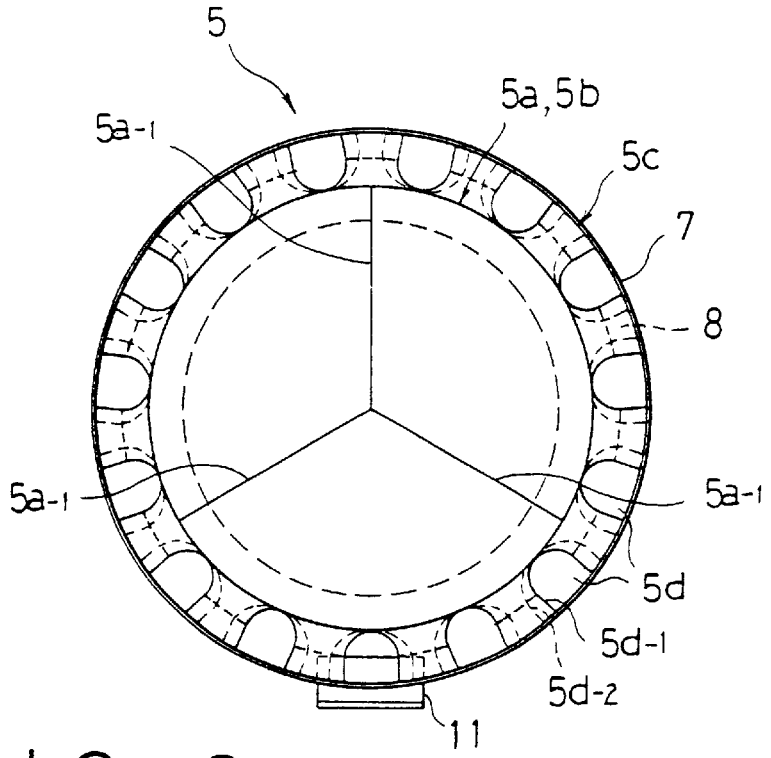
FIG. 2 is a top plan view of a multistage rotational separative feeder.
Figure 3:
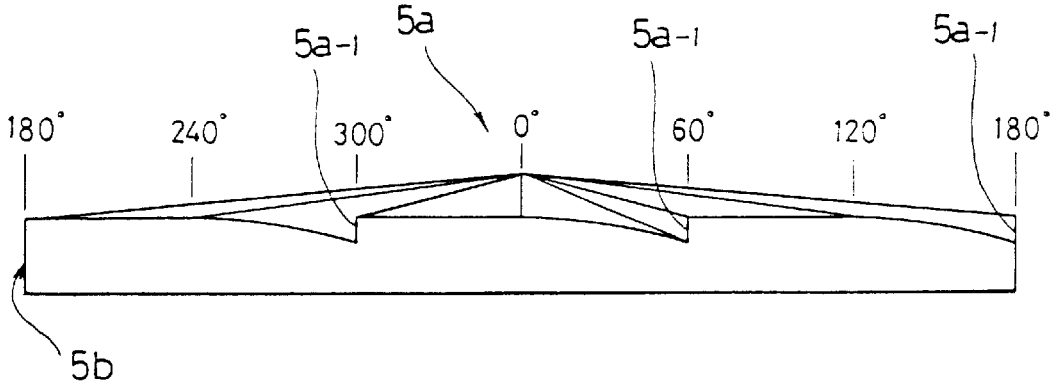
FIG. 3 is an expanded side view of an upper agitating portion and a diametrically smaller portion of the multistage rotational separative feeder.

On the other hand, FIG. 2 is a top plan view of the multistage rotational separative feeder, and FIG. 3 is an expanded side view of the upper agitating portion and the diametrically smaller portion of the multistage rotational separative feeder.

The upper agitating portion 5*a* has a conical side elevation, as shown in FIGS. 1 to 3, and is divided into three sectors, as viewed in a top plan view. Each sector is sloped from the rotationally front side to the rotationally rear side thereby to form a step 5*a*-1 at each side. Thus, the upper agitating portion 5*a* is enabled to agitate a number of pills P by its conical shape and its steps 5*a*-1, 5*a*-1 and 5*a*-l thereby to guide them to its circumferential portion.

As shown in FIG. 1, moreover, the pills, as having fallen down between the diametrically smaller portion 5*b* of the multistage rotational separative feeder 5 and the inner circumference 3*b* of the pill hopper 3, will further fall down into holes 5*d* having a U-shaped top plan view, which are formed at a predetermined pitch to extend vertically through the outer circumference of the diametrically larger portion 5*c* and which are opened at their outer sides. On the outer circumference of the diametrically larger portion 5*c*, there is fixed a metal sheet 7 so that the pills P having fallen down into the holes 5*d* are brought into abutment against the metal sheet 7 in accordance with the rotation of the multistage rotational separative feeder 5. As a result, the pills P are prevented from popping out of the diametrically larger portion 5*c* and abutting against the diametrically larger groove 3*a* of the pill hopper 3 so that neither the diametrically larger groove 3*a* is soiled with dirt, nor the pills P are rubbed and broken.

Moreover, the diametrically larger portion 5*c* of the multistage rotational separative feeder 5 has a ring-shaped groove or slit 8 in the substantially vertical center of the outer circumference.

Figure 4:
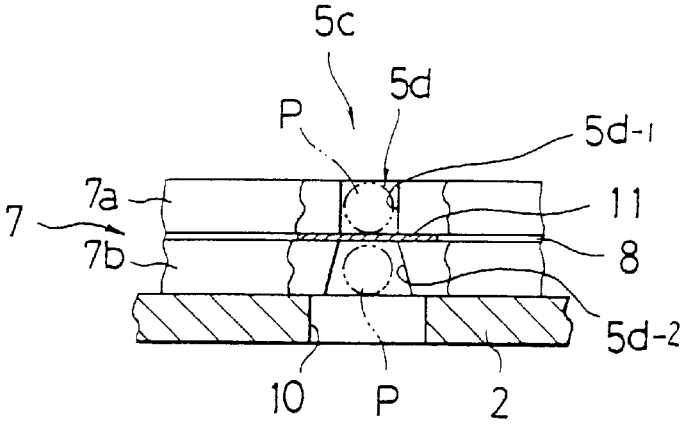
FIG. 4 is an enlarged explanatory side elevation of a diametrically larger portion of the multistage rotational separative feeder.

On the other hand, FIG. 4 is an enlarged explanatory side elevation of the diametrically larger portion of the multistage rotational separative feeder. As shown in FIG. 4, the metal sheet 7 and the individual U-shaped holes 5*d* of the diametrically larger portion 5*c* are vertically halved by the slit 8 so that the metal sheet 7 is divided into an upper metallic sheet 7*a* and a lower metallic sheet 7*b* whereas the holes 5*d* are divided into upper holes 5*d*-1 and lower holes 5*d*-2.

The lower holes 5*d*-2 of the holes 5*d* are so diverged downward that their inside pills may be easily separated from those in the upper holes 5*d*-1 and may easily fall down without any bite.

In the base plate 2, moreover, there is formed a pill exit 10, as shown in FIG. 1. This pill exit 10 can be aligned with one arbitrary hole 5*d* of the multistage rotational separative feeder 5 so that it can be aligned with all the holes 5*d* as the multistage rotational separative feeder 5 is rotated.

On the pill hopper 3 above the pill exit 10, moreover, there is fixed a pill separating plate 11 having an L-shaped side elevation, which has an inwardly projected tip fitted loosely in the slit 8 of the diametrically larger portion 5*c*. This pill separating plate 11 prevents the pills P having fallen down into the upper holes 5*d*-1 of the holes 5*d* of the diametrically larger portion 5*c* from further falling down into the lower holes 5*d*-2.

On the other hand, the shaft 6 is equipped with a position signal detecting sensor 12 for detecting the rotational position of the shaft 6, i.e., the rotational position of the multistage rotational separative feeder 5. One gear 13 of a bevel gear train is fixed on the leading end of the shaft 6, and the other gear 14 meshing with the former gear 13 is fixed on the spindle of a rotational separative feeder drive motor 15 which is a pulse motor. Below the pill exit 10, moreover, there is arranged a pill passage counting sensor 17 for counting the number of pills having passed.

Figure 5:
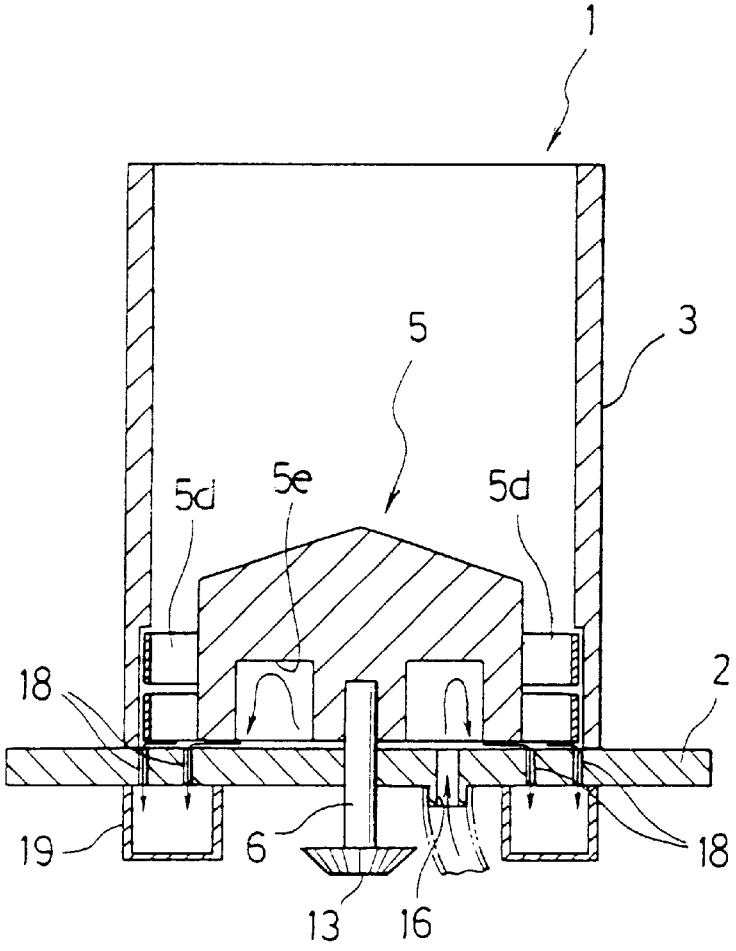
FIG. 5 is a sectional side elevation for explaining the flows of air to be pumped into a groove of the multistage rotational separative feeder.

In the lower face of the multistage rotational separative feeder 5, as shown in FIG. 5, there is formed a ring-shaped groove 5*e* which is in communication with an air inlet 16 formed in the base plate 2. In the base plate 2 below the holes 5*d* of the multistage rotational separative feeder 5, moreover, there are circumferentially formed at a predetermined pitch a plurality of holes 18 and 18 which have a suitably radial spacing from each other. A ring-shaped duct 19 is formed below the numerous holes 18 in the base plate 2.

When the air is pumped into the air inlet 16 by the not-shown blower or the like, the internal pressure in the groove 5*e* of the multistage rotational separative feeder 5 rises so that the air is pumped radially outward along the lower face of the multistage rotational separative feeder 5 until it is discharged into the duct 19 through the numerous holes 18. As a result, owing to the flow of the pumped air the powder of the pills does not bite the shaft 6 but is entrained by the flow of the pumped air and discharged into the duct 19.

Here, arrows in FIG. 5 indicate the flows of air.

In FIG. 1, moreover: reference numeral 20 designates a count detector for receiving and processing the signals coming from the position signal detecting sensor 12, the pill passage counting sensor 17 and a later-described motor drive controller 25; numeral 21 designates a counter for counting the number of pills on the basis of a detection signal coming from the count detector 20; numeral 22 designates a first (high-speed counting) number setter; numeral 23 designates a final number setter; numeral 24 designates a count end output unit; and the numeral 25 designates the motor drive controller for controlling the drive of the rotational separative feeder drive motor 15.

Since the present embodiment is constructed as described hereinbefore, numerous pills P are poured into the upper mouth of the pill hopper 3, and the rotational separative feeder drive motor 15 is activated. Then, the shaft 6 and the multistage rotational separative feeder 5 are rotated through the bevel gears 14 and 13. The pills P are agitated by the steps 5*a*-1, 5*a*-1 and 5*a*-1 of the upper agitating portion 5*a* of the multistage rotational separative feeder 5 and allowed to pass between the diametrically smaller portion 5*b* and the inner circumference 3*b*of the pill hopper 3 until they fall into the upper holes 5*d*-1 and then into the lower holes 5*d*-2 of the individual holes 5*d*of the diametrically larger portion 5*c*. In short, two pills P are vertically accommodated in each hole 5*d* of the diametrically larger portion 5*c* (see FIG. 4).

When the multistage rotational separative feeder 5 is rotated in response to the signal of the motor drive controller 25, one hole 5*d* of the diametrically larger portion 5*c* comes into alignment with the underlying pill exit 10. Then, the hole 5*d* is vertically separated by the pill separating plate 11 so that only the pill P, as caught by the lower hole 5*d*-2, falls down into the pill exit 10 and is detected and counted by the pill passage counting sensor 17.

At this time, the signal of the motor drive controller 25, the rotational position, as detected by the position signal detecting sensor 12, of the multistage rotational separative feeder 5, and the number detected by the pill passage counting sensor 17 are inputted to and processed by the count detector 20.

Here, the pills P having fallen into the pill exit 10 and counted by the pill passage counting sensor 17 are guided through the not-shown hopper and pouring mechanism to fall into a packaging mechanism so that they are accumulated in packages.

Moreover, the number from the count detector 20 is inputted to and processed by the counter 21. If this counted number is within the value set by the first number setter 22, the signal is outputted to the motor drive controller 25 and the latter drives the multistage rotational separative feeder 5 at a high speed.

This high-speed drive of the multistage rotational separative feeder 5 is continued till the counted number from the count detector 20 reaches the first number (e.g., 96) set by the first number setter 22. When this first number is reached, the motor drive controller 25 drives the multistage rotational separative feeder 5 at a low speed.

This low-speed drive of the multistage rotational separative feeder 5 is continued till the counted number from the count detector 20 reaches the final number (e.g., 100) set by the final number setter 23. When this final number is reached, the output of the counter 21 is fed to the count end output unit 24. At the same time, the motor drive controller 25 interrupts the drive of the multistage rotational separative feeder 5, and the counted value of the count detector is cleared.

Moreover, the output signal from the count end output unit 24 is inputted to the not-shown packaging mechanism so that the packages can be interchanged.

Here, when the pills do not fall into the pill exit 10 for a predetermined interval so that they are not counted, the counting is instantly interrupted because even if the signal from the motor drive controller 25 is inputted to the count detector 20 the position signal from the position signal detecting sensor 12 is not changed.

When different pills are to be counted, on the other hand, the multistage rotational separative feeder 5 is removed from the shaft 6, and another multistage rotational separative feeder is fitted on the shaft and the mounting position of the pill separating plate 11 may be vertically adjusted, if necessary.

As a result, the multistage rotational separative feeder 5 is driven at a high speed till the first number is reached, and is driven at a low speed when the first number is reached, so that the pills can be counted at a high speed but without fail.

Moreover, two pills are vertically accommodated in each hole 5*d* of the multistage rotational separative feeder 5 so that the pills can reliably fall from the pill exit 10 and can be reliably counted even if the multistage rotational separative feeder S is driven at a high speed.

Moreover, the metal sheet 7 is fixed on the outer circumference of the diametrically larger portion 5*c* of the multistage rotational separative feeder 5 so that the pills neither pop out of the diametrically larger portion 5*c* nor abut against the diametrically larger groove 3*a* of the pill hopper 3 in accordance with the rotation of the multistage rotational separative feeder 5. As a result, neither the diametrically larger groove 3*a* is soiled with dirt, nor the pills are rubbed to become dirty.

Moreover, the lower holes 5*d*-2 of the holes 5*d* are so diverged downward that the pills may easily fall down without any bite.

Moreover, the pills can be reliably counted by the position signal detecting sensor 12 and the pill passage counting sensor 17.

Next, a second embodiment will be described with reference to FIG. 6.

Figure 6:
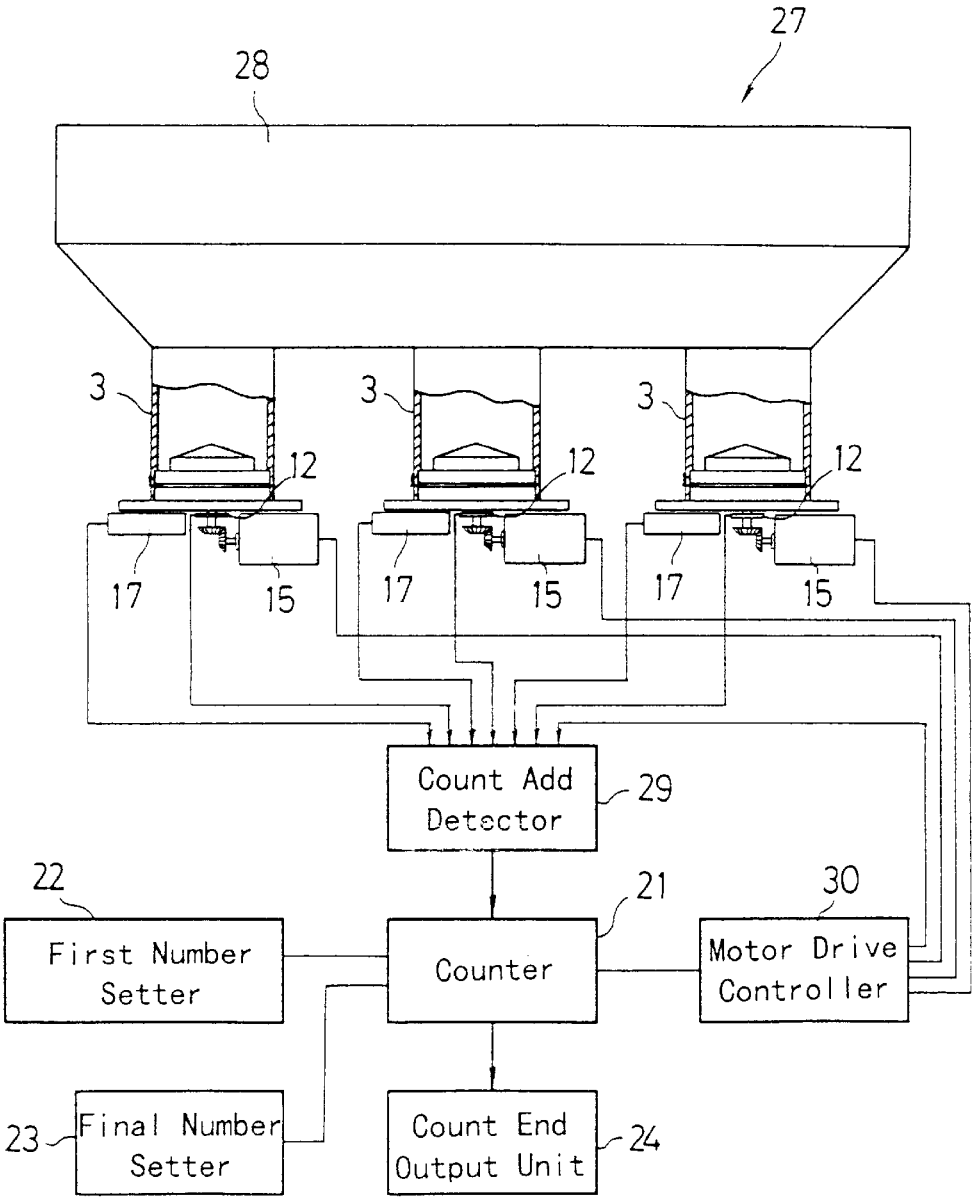
FIG. 6 shows a second embodiment of the automatic high-speed pill counting apparatus according to the invention and is a block diagram of a mechanism and a system of a multi-row automatic high-speed pill counting apparatus.
Figure 7:
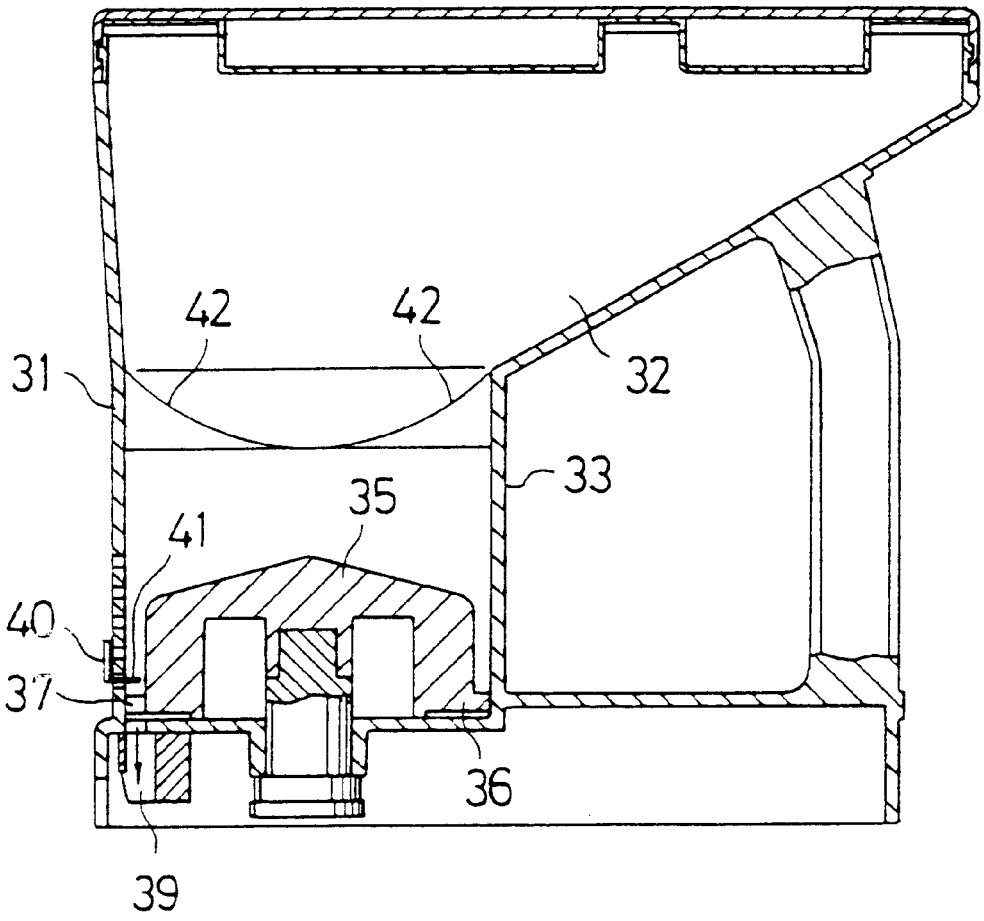
FIG. 7 Prior Art
FIG. 7 is a sectional side elevation showing a separative feed type pill feeder of the prior art.

As shown in FIG. 6, a multi-row automatic high-speed pill counting apparatus 27 is constructed like the foregoing first embodiment, excepting that it is equipped with a single mass hopper 28, that the multiple rows of the aforementioned pill hoppers 3, 3 and 3 are connected to the lower end of the mass hopper 28, that the count detector 20 is replaced by a count add detector 29, and that the motor drive controller 25 for controlling the drive of the single rotational separative feeder drive motor 15 is replaced by a motor drive controller 30 for controlling the drives of a plurality of rotational separative feeder drive motors 15.

At first, the numerous pills P, are poured into the upper mouth of the mass hopper 28 so that the multiple rows of pill hoppers 3, 3 and 3 are charged with the pills P. When the individual rotational separative feeder drive motors 15 are driven under this state, the individual multistage rotational separative feeders 5 are rotated so that the pills P drop from the individual pill exits 10 and are detected and counted by the individual pill passage counting sensors 17. These counted numbers are inputted to and processed by the count add detector 29. Simultaneously with this, the rotational positions, as detected by the individual position signal detecting sensors 12, of the multistage rotational separative feeders 5, and the signals of the motor drive controller 30 are inputted to and processed by the count add detector 29.

Moreover, the multistage rotational separative feeders 5, 5 and 5 on are driven at a high speed till the total number from the count add detector 29 reaches the first number (e.g., 96) set by the first number setter 22. When this first number is reached, the motor drive controller 30 drives only one multistage rotational separative feeder 5 at a low speed but interrupts the drives of the remaining two multistage rotational separative feeders 5 and 5.

Moreover, the one multistage rotational separative feeder 5 is driven at a low speed till the counted number from the count add detector 29 reaches the final number (e.g., 100) set by the final number setter 23. When this final number is reached, the output of the counter 21 is fed to the count end output unit 24. At the same time, the motor drive controller 30 interrupts the drive of the one multistage rotational separative feeder 5, and the counted value of the count add detector 29 is cleared.

Here, the pills P having fallen into the pill exits 10, 10 and 10 and counted by the pill passage counting sensors 17, 17 and 17 are guided through the not-shown hoppers and pouring mechanisms to fall into packaging mechanisms so that they are accumulated in packages. The output signal from the count end output unit 24 is inputted to the not-shown packaging mechanisms so that the packages can be interchanged.

As a result, a plurality of multistage rotational separative feeders are driven at a high speed till the first number is reached, and only one multistage rotational separative feeder is driven at a low speed when the first number is reached, so that the pills can be counted at a higher speed and without fail.

In the foregoing first and second embodiments, two pills are vertically accommodated in each hole 5*d* of the diametrically larger portion 5*c* of the multistage rotational separative feeder. The invention should not be limited thereto but can naturally be so modified that three, four or more pills are vertically accommodated.

In the second embodiment, on the other hand, three multi-row pill hoppers are connected to one mass hopper. The invention should not be limited thereto, but two, four, five or more pill hoppers may be combined.

In the first and second embodiments, on the other hand, the metal sheet 7 is fixed on the outer circumference of the diametrically larger portion 5*c* of the multistage rotational separative feeder. The invention should not be limited to the metal sheet but may adopt a sheet of another material. Alternatively, a number of through holes may naturally be formed in the outer circumference of the multistage rotational separative feeder.

In the first and second embodiments, on the other hand, the rotational separative feeder drive motor is exemplified by the pulse motor. The invention should not be limited thereto but may adopt another type of motor.

EFFECTS OF THE INVENTION

According to the invention, as has been described hereinbefore, the multistage rotational separative feeder is driven at a high speed and is driven at a low speed when a set number is approached, so that the pills can be counted fast and reliably.

Since a plurality of pills are vertically accommodated in each through hole of the multistage rotational separative feeder, moreover, they are reliably allowed to fall down from the pill exit and can be reliably counted even if the multistage rotational separative feeder is driven at a high speed.

Since the numerous through holes are formed in the outer circumference of the lower diametrically larger portion of the multistage rotational separative feeder, moreover, the pills are prevented from popping out to the outside of the lower diametrically larger portion and from abutting against the inner circumference of the pill hopper as the multistage rotational separative feeder rotates, so that neither the inner circumference of the pill hopper is soiled with dirt nor the pills are rubbed to become dirty.

Since the lower portions of the through holes of the lower diametrically larger portion of the multistage rotational separative feeder are diverged downward, moreover, the pills can easily fall down without any bite.

Moreover, the multi-row cylindrical pill hoppers are connected to the lower end of the single mass hopper, and the individual multistage rotational separative feeders in the multi-row cylindrical pill hoppers are driven at a high speed. When the set number is approached, only one multistage rotational separative feeder is driven at a low speed whereas the drive of the remaining multistage rotational separative feeders is interrupted. When the set number is reached, all the drive motors are inactivated. As a result, the pills can be counted at a higher speed and without fail.

What is claimed is:

1. An automatic high-speed pill counting apparatus comprising:

a cylindrical pill hopper having a pill exit and a center hole in a base plate;

a rotational separative feeder rotatably mounted in the lower portion in said cylindrical pill hopper and removably fitted on a shaft borne in the center hole of said base plate, said feeder including an upper diametrically smaller portion and a lower diametrically larger portion having an external diameter approximate to the internal diameter of the lower portion of said pill hopper, a multiplicity of vertically through holes being formed in the outer circumference of said lower diametrically larger portion and allowed to come into alignment with said pill exit for accommodating a plurality of pills vertically, the lower portions of said multiple vertically through holes being diverged downward, a ring-shaped slit being formed in such a position in the outer circumference of said lower diametrically larger portion as to accommodate substantially one pill from the bottom;

a pill separating plate mounted on said cylindrical pill hopper above said pill exit and having an inwardly projected tip fitted loosely in said slit;

a drive motor for driving said shaft; and a pill passage counting sensor arranged below said pill exit.

2. An automatic high-speed pill counting apparatus according to claim 1, wherein the multiple through holes of the lower diametrically larger portion of said rotational separative feeder include a multiplicity of notches formed in the outer circumference of said lower diametrically larger portion, and a thin sheet fixed on the notches in the outer circumference of said lower diametrically larger portion.

3. An automatic high-speed pill counting apparatus according to claim 1, wherein a diametrically larger groove is formed in the lower portion of the inner wall of said cylindrical pill hopper and has a diameter approximate to the external diameter of the lower diametrically larger portion of said rotational separative feeder.

4. An automatic high-speed pill counting apparatus according to claim 1, further comprising:

first control means for controlling in such a manner that said drive motor is driven at a high speed to rotate said rotational separative feeder at a high speed thereby to discharge the pills from said pill exit and count them by said pill passage counting sensor, that when the number of pills is approximate to a set number said drive motor is driven at a low speed to rotate said rotational separative feeder at a low speed and count the pills by said pill passage counting sensor, and that when the number of pills reaches a set number the drive of said drive motor is interrupted.

5. An automatic high-speed pill counting apparatus according to claim 1, wherein multiple rows of said cylindrical pill hoppers are connected to the lower end of one mass hopper, further comprising: second control means for controlling in such a manner that the individual drive motors is driven at a high speed to rotate said indivisual rotational separative feeders at a high speed thereby to discharge the pills from the individual pill exits and add the number counted by said indivisual pill passage counting sensor, that when the number of pills is approximate to a set number only one drive motor is driven at a low speed to rotate one rotational separative feeder at a low speed and count the pills by one pill passage counting sensor thereby to interrupt the drives of the remaining drive motors, and that when the number of pills reaches a set number the drives of all the drive motors are interrupted.

* * * * *